US005908532A

United States Patent [19]

Tenney

[11] Patent Number: 5,908,532

[45] Date of Patent: Jun. 1, 1999

[54] METHOD OF CONVERTING CHLORINE DIOXIDE PRESENT IN A GASEOUS STREAM FROM A PULP BLEACH PLANT BY IRRADIATION TO CHLORINE

[75] Inventor: Joel Tenney, Marietta, Ga.

[73] Assignee: EKA Chemicals, Inc., Marietta, Ga.

[21] Appl. No.: 08/740,533

[22] Filed: Oct. 30, 1996

[51] Int. Cl.[6] ..... D21C 11/06

[52] U.S. Cl. ..... 162/29; 162/67; 204/157.48

[58] Field of Search ..... 162/15, 29, 67, 162/30.11, 31, 87, 88, 89, 66, 30.1, 50; 204/157.48, 197, 462; 423/477, 502, 499.1

[56] References Cited

U.S. PATENT DOCUMENTS 3,127,334 3/1964 Heffels ..... 204/157.48
4,874,489 10/1989 Callerame ..... 204/157.48
5,518,583 5/1996 Nykanen et al. ..... 162/29

FOREIGN PATENT DOCUMENTS 94 02680 2/1994 WIPO .

OTHER PUBLICATIONS

Chemical Abstracts 94(4) :17082, abstract of JP laid open patent application, publ. no. 55098965.

*Primary Examiner*—Steven Alvo
*Attorney, Agent, or Firm*—Lowe, Price, LeBlanc & Becker

[57] ABSTRACT

A method for destroying chlorine dioxide includes irradiating the chlorine dioxide to effect conversion to chlorine and then reacting at least part of the resulting chlorine to form chloride.

10 Claims, 1 Drawing Sheet

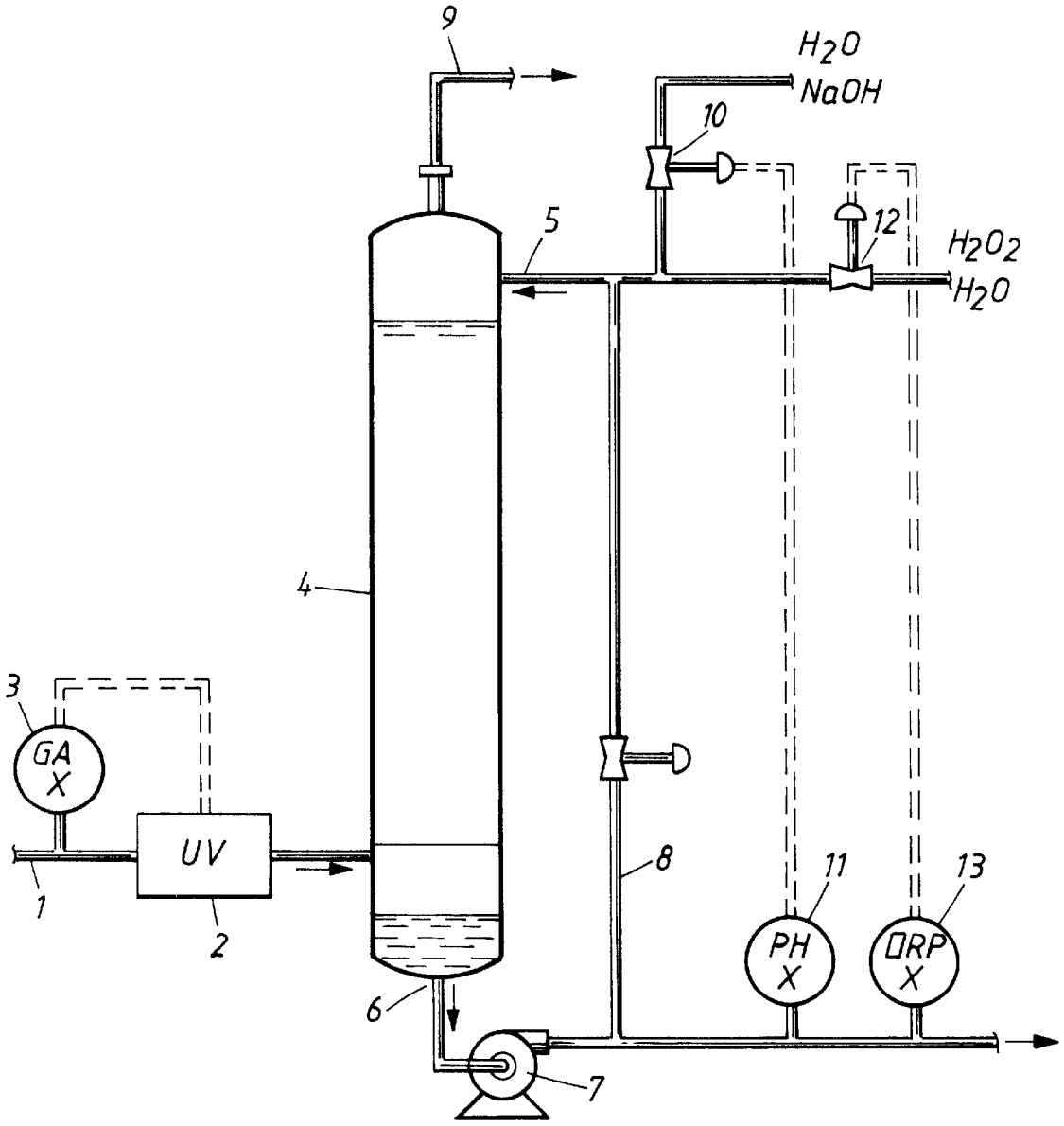
9
$H_2O$
NaOH
10
5
12
$H_2O_2$
$H_2O$
4
3
GA
X
UV
1
2
8
11
13
PH
X
ORP
X
6
7

METHOD OF CONVERTING CHLORINE DIOXIDE PRESENT IN A GASEOUS STREAM FROM A PULP BLEACH PLANT BY IRRADIATION TO CHLORINE

FIELD OF THE INVENTION

The present invention relates to a method of destroying chlorine dioxide.

BACKGROUND OF THE INVENTION

Processes for delignifying or bleaching pulp generally include at least one step of treating the pulp with chlorine dioxide. Also chlorine is a common pulp bleaching agent and even if the bleach plant does not include a chlorine step the chlorine dioxide often contains small amounts of chlorine as an impurity. Waste gases from bleach plants often contain low concentrations of chlorine dioxide as well as of chlorine. For environmental reasons both chlorine dioxide and chlorine must be destroyed or removed, and this is commonly done by scrubbing with different media. Many reactants are efficient for chlorine, for example caustic, but it is hard to find an inexpensive scrubbing media that is effective for both chlorine and chlorine dioxide without causing operational problems such as precipitation of solids or formation of other unwanted by-products.

Chemical Abstracts 94(4):17082, abstract of JP laid open patent application, publ. no. 55098965, discloses treatment of waste gases from textile or wood bleaching with sodium hydroxide in the presence of hydrogen peroxide and sodium silicate for conversion of chlorine dioxide to sodium chlorite.

WO 94/02680 discloses a process of removing color or chlorinated organic compounds from bleach plant effluents by utilizing ultraviolet light and oxygen, ozone, hydrogen peroxide or chlorine dioxide.

However, there is a need for an efficient process of removing or destroying chlorine dioxide and preferably also chlorine in waste gases which does not suffer from operational problems or high costs for chemicals used.

SUMMARY OF THE INVENTION

It has now been found that chlorine dioxide can be destroyed effectively by first converting it to chlorine and oxygen by electromagnetic irradiation, and then reacting the chlorine to chloride with a suitable reactant. Then also any chlorine originally present is effectively destroyed without any additional unit operation and when selecting the reactant it is not necessary to consider the efficiency for chlorine dioxide.

Thus, the invention concerns a method of destroying chlorine dioxide comprising the steps of:

(a) subjecting the chlorine dioxide to electromagnetic irradiation to effect conversion of chlorine dioxide to chlorine; and (b) reacting at least part of the chlorine from step (a) to substantially yield chloride ions.

The conversion of chlorine dioxide follows the formula:

$$ClO_2 \xrightarrow{hv} \tfrac{1}{2} Cl_2 + O_2$$

The electromagnetic irradiation is suitably performed with ultraviolet (UV) light, preferably having a wave length within the range from about 200 to about 500 nm, most preferably from about 300 to about 400. The temperature is not critical and may for example be from about −20 to about =150° C., preferably from about 20 to about 80° C.

The amount of UV energy required varies with the amount of chlorine dioxide to be destroyed and with the efficiency of the lamp. Assuming that the lamp has an energy efficiency of about 25% and that zero order of kinetics apply, the minimum energy requirements will be about 4 kW hrs per kg $ClO_2$ to be destroyed. Thus, the suitable UV dosage will then be from about 4 to about 20 kW hrs per kg $ClO_2$, preferably from about 4 to about 8 kW hrs per kg $ClO_2$, most preferably from about 4 to about 6 kW hrs per kg $ClO_2$.

The irradiated chlorine dioxide is normally included in a gaseous stream, for example from a pulp bleaching plant which stream optionally also contains chlorine. A gaseous stream is normally made up of air suitably containing from almost 0 to about 2000 ppm by weight, preferably from about 50 to about 500 ppm by weight of chlorine dioxide, and optionally also chlorine, for example in an amount from almost 0 to about 20000 ppm by weight, preferably from about 50 to about 500 ppm by weight. The gas may also contain different impurities such as hydrogen sulfide or light weight organics.

The reaction of the chlorine can be effected by treatment with any effective reactant such as aqueous solutions containing any of alkali metal hydroxide, sulfur dioxide, hydrogen peroxide, white liquor, weak wash (similar composition as white liquor but more dilute), E-filtrate (filtrate from an E-stage in a pulp bleachery) or mixtures thereof. The most favorable reactant has been found to be hydrogen peroxide in alkaline solution, preferably a mixture of hydrogen peroxide and alkali metal hydroxide in aqueous solution, which reacts with chlorine very rapidly and does not yield any toxic by-products, only oxygen and chloride are formed in accordance with the following formula:

$$2NaOH+H_2O_2+Cl_2 \rightarrow 2NaCl+2H_2O+O_2$$

A preferred aqueous solution contains from about 0.1 to about 5 grams/liter, preferably from about 0.5 to about 1 gram/liter of hydrogen peroxide. The preferred pH is from about 7 to about 12, preferably from about 10 to about 11.

The reaction of the chlorine can be effected in any suitable standard equipment such as a packed tower or just by spraying the reactant into a gas stream after the conversion to chlorine has been completed. The temperature may, for example, be from about 0 to about 100° C.

BRIEF DESCRIPTION OF THE DRAWING

The FIGURE shows a preferred embodiment of the invention.

DETAILED DESCRIPTION OF A PREFERRED EMBODIMENT

A preferred embodiment of the invention will now be described in connection with the enclosed figure schematically showing a process of the invention. However, the invention is not limited to the embodiment described below.

A gas stream 1 from a pulp bleaching plant containing chlorine dioxide and optionally chlorine flows through a UV-tube 2 which, for example, may contain from 1 to about 100 lamps. The effect of the UV-tube 2 is controlled on the basis of the chlorine dioxide content in the gas stream measured with a gas analyser 3, and normally the total effect is sufficient to convert from about 50 to about 100% of the chlorine dioxide to chlorine. In the UV-tube 2 the chlorine dioxide is converted to chlorine and the gas stream then flows to a packed tower 4 in which the gas is scrubbed in counter flow with an aqueous solution 5 of sodium hydroxide and hydrogen peroxide in the tower 4 the chlorine is reacted to chloride and leaves the tower 4 with the liquid stream 6 which via a pump 7 is removed from the system, although it is possible to recycle part of it through the line 8. The gas stream 9 leaving the tower 4 is substantially free from chlorine and chlorine dioxide. The supply of sodium hydroxide 10 is controlled on the basis of the pH of the liquid stream leaving the tower 4 measured with an instrument 11, while the supply of hydrogen peroxide 12 is controlled on the basis of the redox potential in said stream measured with an instrument 13. Preferably, the redox potential is maintained from about −300 to about +800 mV against calomel as reference electrode.

EXAMPLE

Gas essentially consisting of air containing 11000 ppm by weight of chlorine dioxide and 10 ppm by weight of chlorine flowed at about 500 ml/min through a reaction vessel in which it was irradiated with UV-light at 350 nm. The residence time was about 50 seconds. All chlorine dioxide and chlorine was then removed from the gas stream in a Kl bubbler and analyzed. It was found that the decomposition of chlorine dioxide was complete even when only one 4 W lamp was used.

What is claimed is:

1. A method for destroying chorinc dioxide comprising the steps of:

(a) irradiating chlorine dioxide present in a gaseous stream from a pulp bleaching plant to effect conversion of chlorine dioxide to chlorine; and (b) reacting at least part of the chlorine from step (a) to substantially yield chloride.

2. A method as claimed in claim 1, wherein the electromagnetic irradiation of chlorine dioxide in step (a) is performed with ultraviolet light having a wavelength within the range from about 200 to about 500 nm.

3. A method as claimed in claim 1, wherein the electromagnetic irradiation of chlorine dioxide in step (a) is performed at a temperature from about 20 to about 80° C.

4. A method as claimed in claim 1, wherein the chlorine dioxide in step (a) is included in a gaseous stream also containing chlorine.

5. A method as claimed in claim 4, wherein the gaseous stream contains from 0 to about 20000 ppm by weight of chlorine.

6. A method as claimed in claim 1, wherein the gaseous stream contains from 0 to about 2000 ppm by weight of chlorine dioxide.

7. A method as claimed in claim 1, wherein the reaction of chlorine in step (b) includes treating the chlorine with an aqueous solution containing any of alkali metal hydroxide, sulfur dioxide, hydrogen peroxide, weak wash, white liquor, E-filtrate or mixtures thereof.

8. A method as claimed in claim 7, wherein the reaction of chlorine in step (b) includes treating the chlorine with hydrogen peroxide in alkaline solution.

9. A method as claimed in claim 8, wherein the reaction of chlorine in step (b) includes treating the chlorine with a mixture of hydrogen peroxide and alkali metal hydroxide in aqueous solution.

10. A method as claimed in claim 1, wherein the reaction of chlorine in step (b) is effected at a pH from about 7 to about 12.

* * * * *